US010118218B2

(12) United States Patent
Murakami et al.

(10) Patent No.: US 10,118,218 B2
(45) Date of Patent: Nov. 6, 2018

(54) METHOD FOR CONTINUOUSLY CASTING SLAB

(71) Applicant: NIPPON STEEL & SUMITOMO METAL CORPORATION, Tokyo (JP)

(72) Inventors: Toshihiko Murakami, Kashima (JP); Hiroyuki Yotsuhashi, Fukuoka (JP); Shin Takaya, Narita (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/541,499

(22) PCT Filed: Jan. 7, 2016

(86) PCT No.: PCT/JP2016/050304
§ 371 (c)(1),
(2) Date: Jul. 5, 2017

(87) PCT Pub. No.: WO2016/114208
PCT Pub. Date: Jul. 21, 2016

(65) Prior Publication Data

US 2018/0015533 A1 Jan. 18, 2018

(30) Foreign Application Priority Data

Jan. 15, 2015 (JP) ..... 2015-006209

(51) Int. Cl.
*B22D 11/049* (2006.01)
*B22D 11/124* (2006.01)
(Continued)

(52) U.S. Cl.
CPC ..... *B22D 11/049* (2013.01); *B22D 11/041* (2013.01); *B22D 11/043* (2013.01);
(Continued)

(58) Field of Classification Search
CPC ... B22D 11/041; B22D 11/049; B22D 11/124; B22D 11/16; B22D 11/22
(Continued)

(56) References Cited

U.S. PATENT DOCUMENTS 8,522,858 B2 * 9/2013 Plociennik ..... B22D 11/141 164/444

FOREIGN PATENT DOCUMENTS

JP 63112058 A * 5/1988
JP 10-001719 1/1998
(Continued)

*Primary Examiner* — Kevin E Yoon
(74) *Attorney, Agent, or Firm* — Clark & Brody

(57) ABSTRACT

To provide a continuous casting method according to which a slab difficult for surface cracking to appear can be manufactured, in a first water cooling step, the slab is cooled so that only a surface temperature of corner parts is below $Ar_3$ point, in a first recuperation step, the slab is recuperated so that the surface temperature of all the slab including the corner parts is no less than the $Ar_3$ point, in a second water cooing step, the slab is cooled so that the surface temperature of all the slab including the corner parts is below the $Ar_3$ point, and in a second recuperation step, the slab is recuperated so that the surface temperature of only a portion of the slab other than the corner parts is no less than the $Ar_3$ point.

8 Claims, 7 Drawing Sheets

(51) Int. Cl.

| | |
|---|---|
| ***B22D 11/22*** | (2006.01) |
| ***B22D 11/041*** | (2006.01) |
| ***B22D 11/043*** | (2006.01) |
| ***B22D 11/16*** | (2006.01) |
| ***C21D 1/00*** | (2006.01) |

(52) U.S. Cl.
CPC ..... *B22D 11/124* (2013.01); *B22D 11/16* (2013.01); *B22D 11/22* (2013.01); *C21D 1/00* (2013.01)

(58) Field of Classification Search
USPC ..... 164/455, 485–487
See application file for complete search history.

(56) References Cited

FOREIGN PATENT DOCUMENTS

| | | | | | |
|---|---|---|---|---|---|
| JP | 2002-307149 | | | 10/2002 | |
| JP | 2005-040837 | | | 2/2005 | |
| JP | 2007245232 | A | * | 9/2007 | |
| JP | 2010209416 | A | * | 9/2010 | |
| JP | 2015006684 | A | * | 1/2015 | |
| WO | WO-2016013186 | A1 | * | 1/2016 | ..... B22D 11/04 |

* cited by examiner

METHOD FOR CONTINUOUSLY CASTING SLAB

TECHNICAL FIELD

The present invention relates to methods for continuously casting slabs, and specifically relates to a method for continuously casting a slab using a curved type or vertical bending type continuous casting machine.

BACKGROUND ART

In continuous casting, molten steel is poured from a ladle into a tundish, and further, this molten steel is poured into a mold. A solidified shell forms along the outer circumferential part of the molten steel in the mold, and a cast slab in this state (the solidified shell and the molten steel inside the solidified shell) is withdrawn beneath the mold. After that, the cast slab is solidified to the inside by secondary cooling in a spray zone. The cast slab obtained as described above is cut into proper sizes. If necessary, the cast slab is adjusted to proper temperature by bloom reheating, and after that, blooming is carried out thereon.

Cracks appear in surfaces of the cast slab upon bloom reheating according to cooling conditions for the cast slab. Therefore, methods for cooling cast slabs are figured out in order to prevent such cracking. For example, for the purpose of refining the structure of the outer layer of a cast slab, the cast slab is cooled (tertiary cooling) after being cut, using a bloom cooler that is a cooling device outside a continuous casting machine.

Patent Literature 1 describes that after being cut into prescribed lengths, the bloom cast by a continuous casting is cooled from the temperature range just above $Ar_3$ point by using a bloom cooler. According to Patent Literature 1, the bloom is cooled by controlling the water quantity density of the upper surface of the bloom that is horizontally placed to $5\times10^{-4}$ to $4\times10^{-3}$ $m^3/sm^2$ (=30 to 240 $L/min/m^2$), and the water quantity density of the side surfaces thereof and the lower surface thereof are differentiated from that of the upper surface thereof, so that cracks appearing at the time of cooling the bloom can be prevented.

Patent Literature 2 describes that when cooling a bloom at a temperature right above the $Ar_3$ point by using a bloom cooler, the transfer velocity of the bloom is made to be 3 to 10 m/rnin. According to Patent Literature 2, whereby, the bloom is cooled in a manner that the bottom side of the bloom is evenly cooled.

Each method of Patent Literatures 1 and 2 is intended for the existence of a structure where γ grains are refined in the outer layer of the bloom at the time point when bloom reheating is carried out.

On the other hand, in Patent Literature 3, secondary cooling of quenching of the cast slab is performed, and whereby the structure of the outer layer of the cast slab is reformed to that of high hot ductility, to obtain the cast slab having no cracks on the surfaces.

CITATION LIST

Patent Literature

Patent Literature 1: JP H10-1719A
Patent Literature 2: JP2005-40837A
Patent Literature 3: JP 2002-307149A

SUMMARY OF INVENTION

Technical Problem

There is a case where cracks appear upon recuperation of a cast slab, and cracks appear upon blooming whichever method of Patent Literature 1 and 2 is employed. It is considered that this is caused by: part of a cast slab becomes martensite when the cast slab is quenched, to expand upon recuperation; and heat stress is generated between the outer layer and the inside of the cast slab upon bloom reheating.

In recent years, methods of extremely reducing the cooling capacity of tertiary cooling, etc. are proposed. However, no methods can achieve enough effect.

In addition, corner parts of a cast slab shrink upon cooling in two directions that are width direction (long sides direction) and thickness direction (short sides direction) of the cast slab. Therefore, according to the method of Patent Literature 3, cracks at corner parts tend to increase when quenching so as to reform structures of long sides surfaces of the cast slab is performed.

An object of the present invention is to provide a continuous casting method according to which a slab difficult for surface cracking to appear in the process from secondary cooling to blooming can be manufactured.

Solution to Problem

The inventors divided cooling for reforming the structure of a slab upon secondary cooling into cooling only for reforming the structure of the corner parts of the slab (which are, in the present invention, regions within 20 mm from the apexes and the sides of the slab. Hereinafter the same will be applied) (first water cooling step) and cooling for reforming the structure of the portion other than the corner parts of the slab (second water cooling step). After the end of the first water cooling step of cooling the slab so that the surface temperature of the corner parts of the slab was below the $Ar_3$ point, a recuperation step of recuperating all the long sides surfaces of the slab including the corner parts to temperature of the $Ar_3$ point or above was carried out. After the recuperation step was carried out, the second water cooling step of cooling all the long sides surfaces of the slab including the corner parts below the $Ar_3$ point was carried out. After the end of the second water cooling step, the temperature of the corner parts of the slab was kept below the $Ar_3$ point, and also, that of the portion other than the corner parts of the slab was recuperated to the $Ar_3$ point or above. As a result, the slab, where the structures of all over the surfaces including the corner parts were reformed, was obtained, which made it possible to prevent surface cracking in the process from secondary cooling to blooming. The present invention was completed based on the above finding. Hereinafter the present invention will be described. In the description below, "$Ar_3$ point to 900° C." means "no less than the $Ar_3$ point and less than 900° C. Other "X to Y", which indicate numerical ranges, mean "no less than X and no more than Y" unless otherwise specified.

A gist of the present invention is a method for continuously casting a slab using a curved type or vertical bending type continuous casting machine, the method comprising: the step of cooling the slab just beneath a mold in a secondary cooling zone, the slab being withdrawn from the mold, the step further comprising: a first water cooling step, a first recuperation step that follows the first water cooling step, a second water cooling step that follows the first recuperation step, and a second recuperation step that follows the second water cooling step, wherein the first water cooling step is a step of cooling the slab of which a surface temperature is no less than 1000° C., by supplying cooling water to wide surfaces of the slab, including that only a surface temperature of a corner part is below $Ar_3$ point, and a surface temperature of a portion of the slab other than the corner part is kept no less than $Ar_3$ point, the corner part being a region within 20 mm from an apex and edges of the slab, the first recuperation step is a step of recuperating the slab including that the surface temperature of all the slab including the corner part is no less than the $Ar_3$ point, the second water cooing step is a step of cooling the slab of which the surface temperature is the $Ar_3$ point to 900° C., by supplying the cooling water to the wide surfaces of the slab, including that the surface temperature of all the slab including the corner part is below the $Ar_3$ point, and the second recuperation step is a step of recuperating the slab including that the surface temperature of the corner part is kept below the $Ar_3$ point, and the surface temperature of the portion of the slab other than the corner part is no less than the $Ar_3$ point.

Here, "slab" in the present invention means a cast slab of no less than 200 mm in thickness, having a large cross-section. The slab in the present invention includes what is called "slab (cast slab)" and "bloom (cast bloom)". Also, "no less than 1000° C", which is the surface temperature of the slab when cooling according to the first water cooling step is started, and "$Ar_3$ point to 900° C", which is the surface temperature of the slab when cooling according to the second water cooling step is started, indicate temperature at regions of 10 mm in depth from surfaces, at the center of the slab in the width direction. "Surface temperature" of the corner part of the slab and that of the portion other than the corner part, which are controlled to be either lower than the $Ar_3$ point or no less than the $Ar_3$ point according to cooling and recuperation also indicate temperature at regions of 10 mm in depth from surfaces of the slab. These surface temperatures can be obtained by, for example, calculation of heat transfer analysis. "Wide surfaces" refer to surfaces not including short sides out of long sides (sides in the width direction of the slab) and the short sides (sides in the thickness direction of the slab) which define a cross-section obtained by cutting the slab across a place for which the longitudinal direction of the slab is the direction of a normal line. In other words, wide surfaces refer to top and bottom surfaces of the slab. "First water cooling step" and "second water cooling step" in this invention are steps of water-cooling all over the wide surfaces of the slab including the corner part by, from the top and bottom surface sides of the slab, supplying cooling water to all over the wide surfaces of the slab in a case where the slab is a cast slab, and supplying cooling water to the portion of the wide surfaces other than the corner part in a case where the slab is a bloom.

A structure where γ grain boundaries are unclear can be formed only in the outer layer (referring to a region of 5 to 10 mm in thickness from the outermost surface of the slab. Hereinafter the same will be referred to) of the corner part of the slab by recuperating the corner part, which are cooled to temperature below the $Ar_3$ point in the first water cooling step, to temperature of the $Ar_3$ point or above in the first recuperation step where sensible heat and latent heat of unsolidified molten steel existing inside the slab are used. This structure is mixed structure of ferrite and pearlite. More specifically, this is a solidification structure where ferrite is granularly generated between γ grain boundaries when the slab is cooled from higher temperature to temperature lower than the $Ar_3$ point. This structure has hot ductility. Here, the temperature has to be raised back to the $Ar_3$ point or over once lowered below the $Ar_3$ point in order to form the structure where γ grain boundaries are unclear. In this invention, the surface temperature of the portion other than the corner part of the slab in each first water cooling step and the first recuperation step is the $Ar_3$ point or above. Thus, the structure where γ grain boundaries are unclear does not form in the portion other than the corner part of the slab even through the first water cooling step and the first recuperation step.

Next, a structure where γ grain boundaries are unclear, which is the same as the structure formed in the corner part of the slab, can be formed in the outer layer of the portion other than the corner part of the slab by recuperating the portion other than the corner part, which is cooled to temperature below the $Ar_3$ point in the second water cooling step, to temperature of the $Ar_3$ point or above in the second recuperation step where sensible heat and latent heat of unsolidified molten steel existing inside the slab is used. On the other hand, temperature of the corner part of the slab, where the structure where γ grain boundaries are unclear is formed in the first water cooling step and the first recuperation step, rises according to recuperation in the second recuperation step after cooling in the second water cooling step. However, the temperature is kept below the $Ar_3$ point. The structure where γ grain boundaries are unclear, which is once formed, is further cooled two-dimensionally without reaching temperature of the $Ar_3$ point or over. Thus, a reverse-transformed structure (refined structure by recrystallization of a structure where transformation of γ->α (ferrite)+P (pearlite) is performed) is not formed.

Therefor, the structure is kept even through the second water cooling step and the second recuperation step. Thus, the slab where the structure of the outer layer of the corner part and that of the portion other than the corner part are reformed can be manufactured by passing through the above described four steps. It is possible to prevent surface cracking in the process from secondary cooling to blooming by reforming the structure of all over the outer layer of the slab.

In the above described present invention, preferably, flow density of the cooling water supplied to the slab in the first water cooling step is 170 to 290 L/min/$m^2$, and time for supplying the cooling water to the slab in the first water cooling step is 0.95 to 4.0 minutes.

In the above described present invention, preferably, flow density of the cooling water supplied to the slab in the second water cooling step is 170 to 290 L/min/$m^2$, and time for supplying the cooling water to the slab in the second water cooling step is 0.95 to 4.0 minutes.

In the present invention, "flow density of cooling water" refers to the flow density of cooling water supplied to the top and bottom surfaces of the slab, which is the amount of water supplied to the slab per unit surface area and unit time. "Time for supplying cooling water" refers to the time (cooling time) for which cooling water is supplied to the top and bottom surfaces of the slab. The flow density and time for supplying cooling water in the first water cooling step and the second water cooling step within the above ranges makes it easy to form the structure where γ grain boundaries are unclear in the outer layer of the corner part and that of the portion other than the corner part by cooling with the smaller amount of cooling water than conventional amounts. Whereby, it is possible to prevent surface cracking in the process from secondary cooling to blooming even if the amount of cooling water used in the secondary cooling zone is smaller than conventional amounts. Here, in the longitudinal direction of the slab, a portion to perform water cooling in the second water cooling step is downstream in the moving direction of the slab compared to a portion to perform water cooling in the first water cooling step, and thus, the former portion is low temperature. Therefore, it is possible to cool the portion other than the corner part of the slab to temperature below the $Ar_3$ point even if the amount of used cooling water is smaller in the second cooling step, compared to that in the first water cooling step.

In the above described present invention, preferably, time for recuperating the slab in the first recuperation step is no less than 2 minutes.

In the above described present invention, preferably, time for recuperating the slab in the second recuperation step is no less than 2 minutes.

In the first recuperation step, for example, time for recuperating the slab is 2 minutes or more, which makes it easy to recuperate the outer layer of the slab substantially all across the surfaces of the slab in the width direction, to temperature of the $Ar_3$ point or above. In the second recuperation step, for example, time for recuperating the slab is 2 minutes or more, which makes it easy to recuperate the outer layer of the portion other than the corner part of the slab, to temperature of the $Ar_3$ point or above. The structure where γ grain boundaries are unclear can be formed by recuperation to temperature of the $Ar_3$ point or above after cooling to temperature below the $Ar_3$ point. Thus, this configuration prevents surface cracking in the process from secondary cooling to blooming.

FIG. 1 depicts an example of the relationship between passing time and temperature of the surface and inside the slab, which is water-cooled. The surface temperature was temperature measured with a thermocouple disposed on a surface of the slab. The inside temperature was temperature measured with a thermocouple disposed in a portion of 22 mm in depth from a surface of the slab. In this example, the $Ar_3$ point was 1123 K. It can be seen that the surface temperature of the slab was recuperated to the $Ar_3$ point or above between the time when water cooling was stopped (shown by the dash dot line T0) and the time when 2 minutes have passed (shown by the dash dot line T2), and when 3 minutes have passed (shown by the dash dot line T3).

On the other hand, as shown in FIG. 1, the effect of recuperation to the $Ar_3$ point or above was not obtained any more even if the recuperation time took longer than 3 minutes. Therefore, preferably, the recuperation time is, for example, 2 to 3 minutes.

Advantageous Effects of Invention

According to the present invention, the slab, in almost all over the surfaces of which a structure of high hot ductility is formed, can be manufactured while cracking in the corner part of the slab is restricted. Whereby, it can be prevented to appear cracks in surfaces of the slab in the process from secondary cooling to blooming (for example, the secondary cooling step, a recuperation step, a bloom heating step and a blooming step).

DESCRIPTION OF EMBODIMENTS

Hereinafter embodiments of the present invention will be described. The embodiments described below are examples of the present invention, and the present invention is not limited thereto. In this invention, configurations in cooling and recuperation in a secondary cooling zone where a slab withdrawn beneath a mold is cooled are specifically identified.

Figure 2:
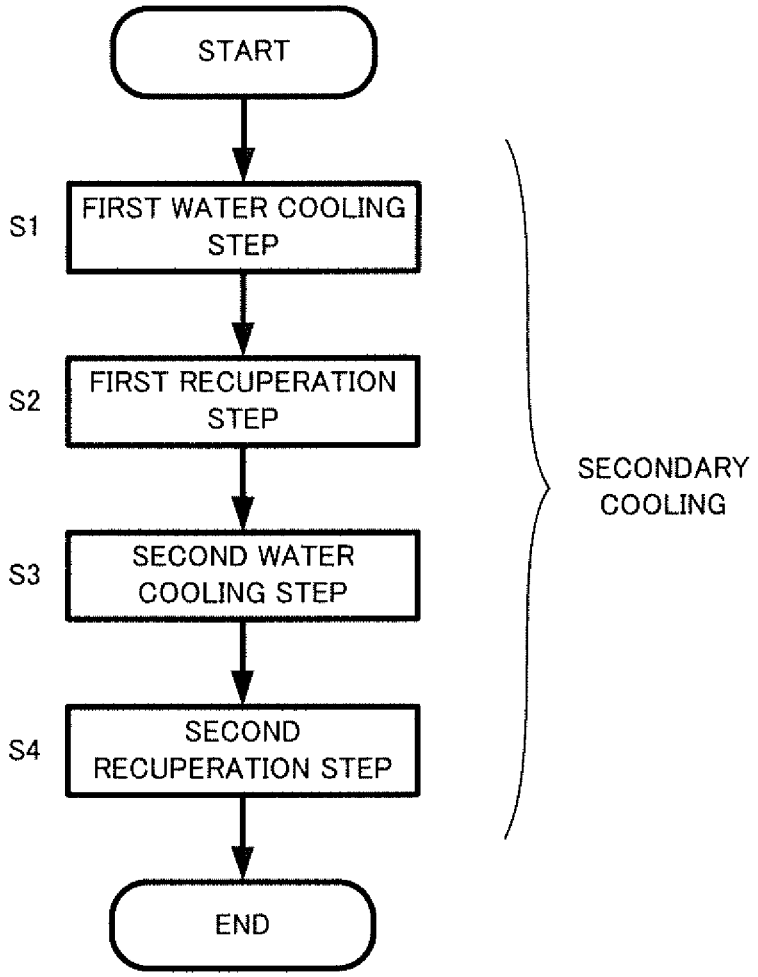
FIG. 2 is an explanatory view of the method for continuously casting a slab in the present invention.

FIG. 2 is an explanatory view of the method for continuously casting a slab in the present invention. As shown in FIG. 2, the present invention includes a first water cooling step (S1), a first recuperation step (S2), a second water cooling step (S3), and a second recuperation step (S4). S1 to S4 are steps included in the secondary cooling zone.

<First Water Cooling Step (S1)>

The first water cooling step (hereinafter may be referred to as "S1") is a step of cooling the slab by supplying cooling water to the wide surfaces of the slab, a surface temperature of which is 1000° C. or above, so that only the surface temperature of the corner part of the slab is below the $Ar_3$ point, and that of the portion of the slab other than the corner part is kept the $Ar_3$ point or above.

As described above, in the present invention, the structure of the corner part of the slab and the structure of the portion other than the corner part of the slab are individually reformed. After the structure of the corner part of the slab are reformed, that of the portion other than the corner part of the slab is reformed. S1 is a step for carrying out cooling necessary for reforming only the structure of the corner part of the slab. Here, for reforming a structure in this invention, a portion desired to reform its structure has to be cooled once to temperature below the $Ar_3$ point. Since S1 is a step for carrying out cooling necessary for reforming the structure of the corner part of the slab, a portion to be cooled to temperature below the $Ar_3$ point in S1 is the corner part of the slab only, and the surface temperature of the portion other than the corner part of the slab is kept temperature of the $Ar_3$ point or above. That is, in S1, the slab is cooled by supplying cooling water to the slab so that the surface temperature of the portion other than the corner part of the slab is kept the $Ar_3$ point or above, and the surface temperature of the corner part of the slab is below the $Ar_3$ point.

While the portion other than the corner part of the slab has only one surface, the corner part of the slab has at least two surfaces. Thus, the corner part of the slab is easier to be cooled arid more difficult to be recuperated than the portion other than the corner part of the slab. Since the corner part of the slab is easier to be cooled than the portion other than the corner part of the slab, the slab can be cooled by cooling the slab using the smaller amount of cooling water than conventional amounts so that only the surface temperature of the corner part of the slab is below the $Ar_3$ point, and the surface temperature of the portion other than the corner part of the slab is kept the $Ar_3$ point or above.

In the present invention, the configuration of S1 is not limited as long as the slab can be cooled so that only the surface temperature of the corner part of the slab is below the $Ar_3$ point, and the surface temperature of the portion other than the corner part of the slab is kept the $Ar_3$ point or above. Such cooling is easily performed by, for example, supplying cooling water of 170 to 290 L/min/$m^2$ in flow density to the slab for 0.95 to 4.0 minutes. Thus, preferably, the flow density of cooling water supplied to the slab in S1 is 170 to 290 L/min/$m^2$, and time for supplying cooling water to the slab in S1 is 0.95 to 4.0 minutes.

<First Recuperation Step (S2)>

The first recuperation step (hereinafter may be referred to as "S2") is a step performed following S1, and a step of performing recuperation necessary to only reform the structure of the corner part of the slab. Specifically, S2 is a step of recuperating the slab so that the surface temperature of all over the slab including the corner part is the $Ar_3$ point or above. As described above, the corner part of the slab is cooled so that its surface temperature is below the $Ar_3$ point in S1. Thus, the structure where γ grain boundaries are unclear can be formed in the outer layer of the corner part of the slab by recuperating the slab in S2 so that all the surface temperature including the corner part of the slab is the $Ar_3$ point or above. This structure has hot ductility. It is noted that in S2, even the surface temperature of the portion other than the corner part of the slab is the $Ar_3$ point or above. However, the surface temperature of the portion other than the corner part of the slab is the $Ar_3$ point or above in S1 already. Therefore, the structure where γ grain boundaries are unclear is not formed in the portion other than the corner part of the slab even S2 is performed.

Figure 1:
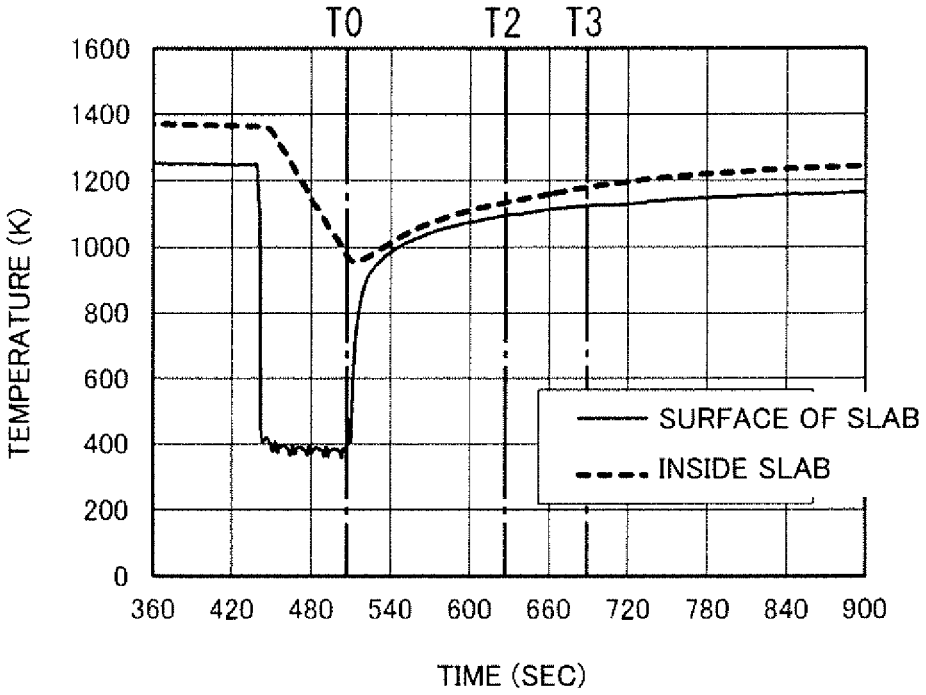
FIG. 1 depicts an example of the relationship between passing time and temperature of a surface and inside of the slab, which is water-cooled.

In the present invention, the configuration of S2 is not limited as long as the slab can be recuperated so that all the surface temperature of the slab including the corner part is the $Ar_3$ point or above. Such recuperation is easily performed by, for example, taking the time for recuperating the slab at least 2 minutes or more, and preferably 2 to 3 minutes. In the example shown in FIG. 1, the surface temperature of the slab was recuperated to the $Ar_3$ point or above between the time when 2 minutes have passed and the time when water cooling was stopped, and the time when 3 minutes have passed and the time when water cooling was stopped. The inventors have confirmed that it is possible to recuperate the slab to temperature of the $Ar_3$ point or above by recuperating the slab for 2 minutes.

<Second Water Cooling Step (S3)>

The second water cooling step (hereinafter may be referred to as "S3") is a step of cooling the slab by supplying cooling water to the wide surfaces of the slab, surface temperature of which is the $Ar_3$ point to 900° C., so that all the surface temperature of the slab including the corner part is below the $Ar_3$ point.

S3 is a step of preforming cooling necessary to reform the structure of the potion other than the corner part of the slab. As described above, for reforming a structure in this invention, a portion desired to reform its structure has to be cooled once to temperature below the $Ar_3$ point. In S3, the slab is cooled so that the surface temperature of the portion other than the corner part of the slab is below the $Ar_3$ point. Here, as described above, since the corner part of the slab is easier to be cooled than the portion other than the corner part of the slab, the surface temperature of the corner part of the slab is lower than that of the portion other than the corner part of the slab. Therefore, if the slab is cooled so that the surface temperature of the portion other than the corner part of the slab is below the $Ar_3$ point, that of the corner part of the slab is also below the $Ar_3$ point. Thus, S3 can be expressed by a step of cooling the slab so that all the surface temperature of the slab including the corner part is below the $Ar_3$ point.

In the present invention, the configuration of S3 is not limited as long as the slab can be cooled so that all the surface temperature of the slab including the corner part is below the $Ar_3$ point. Such cooling can be easily performed by, for example, supplying cooling water of 170 to 290 L/min/$m^2$ in flow density to the slab for 0.95 to 4.0 minutes. Thus, preferably, the flow density of cooling water supplied to the slab in S3 is 170 to 290 L/min/$m^2$, and time for supplying cooling water to the slab in S3 is 0.95 to 4.0 minutes. It is noted that the surface temperature of the slab cooled in S3 is lower than that cooled in S1. Therefore, it is possible to cool the portion other than the corner part and the corner part of the slab, to temperature lower than that in S1 even if the flow density of cooling water, and time for supplying cooling water are same as S1.

<Second Recuperation Step (S4)>

The second recuperation step (hereinafter may be referred to as "S4") is a step performed following S3, and a step of performing recuperation necessary to reform the structure of the portion other than the corner part of the slab. Specifically, S4 is a step of recuperating the slab so that the surface temperature of the corner part is kept below the $Ar_3$ point, and that of the portion other than the corner part is the $Ar_3$ point or above. As described above, the portion other than the corner part (and the corner part) of the slab is cooled so that its surface temperature is below the $Ar_3$ point in S3. Thus, the structure where γ grain boundaries are unclear can be formed in the outer layer of the portion other than the corner part of the slab by recuperating the slab in S4 so that the surface temperature of the portion other than the corner part of the slab is the $Ar_3$ point or above. This structure has hot ductility. The outer layers of all the long sides surfaces of the slab including the corner part are reformed to have the structure where γ grain boundaries are unclear in the slab through S1 to S4.

In S4, the surface temperature of the corner part of the slab is kept below the $Ar_3$ point. This is because there is no necessity to be the surface temperature of the corner part of the $Ar_3$ point or above in S4 since the structure of the corner part of the slab has been completely reformed in S1 and S2, etc. The surface temperature of the corner part of the slab after cooled in S3 is lower than that in S1, and the corner part of the slab is difficult to be recuperated. Thus, in S4, the surface temperature of the corner part can be easily kept below the $Ar_3$ point.

In the present invention, the configuration of S4 is not limited as long as the slab can be recuperated so that the surface temperature of the corner part is kept below the $Ar_3$ point and that of the portion other than the corner part is $Ar_3$ point or above. Such recuperation can be easily performed by, for example, taking the time for recuperating the slab at least 2 minutes or more, and preferably 2 to 3 minutes.

According to the present invention including S1 to S4, the corner part and the portion other than the corner part of the slab can be individually reformed, and cracks in all over the outer layer of the slab including the corner part can be prevented. After S4 is ended, a structure of high hot ductility forms in almost all over the outer layer of the slab. Whereby, heat stress that can be generated between the outer layer and the inside of the slab can be reduced. As a result, surface cracking of the slab can be restricted not only upon cooling in the first and second water cooling steps but also upon recuperation in the first and second recuperation steps, recuperation after secondary cooling, bloom reheating, and blooming. That is, according to the present invention, surface cracking can be made to be difficult to appear in the process from secondary cooling to blooming.

It is considered that only end parts of the slab are cooled, and only a portion other than the end parts is cooled as methods for reforming the structure of the corner part individually from that of the portion other than the corner part, without using the present invention. However, it is difficult to actually perform such cooling. For example, it is considered that the disposition of sprays is figured out so that cooling water does not splash directly on end parts of the slab. However, rolls for supporting the slab are provided just beneath the mold and therefore, cooling water sprayed onto the slab is supplied to the corner part along these rolls. The corner part is cooled from the wide surfaces where cooling water is supplied, and the side surfaces of the wide surfaces, and thus, is easy to be supercooled and difficult to be recuperated.

EXAMPLES

The present invention will be further described with reference to examples.

In order to confirm effects of the present invention, a cooling test of the slab was done using a casting machine for full-scale production, to examine the relationship between cooling conditions (flow density and cooling time), and the structure of the outer layer of the slab. As examples, (examples of this invention), water cooling in the first water cooling step, recuperation in the first recuperation step, water cooling in the second water cooling step, and recuperation in the second recuperation step were executed. In addition, as comparative examples of conventional arts, cooling in one continuous cooling step, which was not divided into two series of cooling, was executed, and after that, a recuperation step was executed. In every cooling step, cooling water was sprayed from spray nozzles to long sides surfaces and short sides surfaces of the slab, to cool the slab.

Specifically, a cooling test was carried out when continuous casting was performed at 0.6 to 0.8 m/min in casting speed to obtain a slab of 0.15 to 0.23 wt % in C content, 435 mm in width and 315 mm in thickness. In each example, the flow density of spray water in each first water cooling step and second water cooling step was 170 to 290 L/min/m$^2$, and the time for supplying cooling water to the slab (cooling time) in each first water cooling step and second water cooling step was 0.95 to 3.7 minutes. In some comparative examples, sizes of the slabs were 650 mm in width and 300 mm in thickness. Table 1 shows the test conditions and the results of the appearance or not of cracks of the examples. Table 2 shows the test conditions and the results of the appearance or not of cracks of the comparative examples. In each test, whether cracks appeared or not was determined by: cutting a sample out of the slab, pickling to remove scales, and visually inspecting whether cracks appeared or not. Specifically, in a case where cracks were visually observed, cracks were determined to "appear". In a case where no cracks were visually observed, cracks were determined to be "none". In Table 2, "–" indicates that steps corresponding to boxes indicated by "–" were not carried out.

TABLE 1

| | First Water Cooling Step | | First Recuperation Step | Second Water Cooing Step | | Second Recuperation Step | Appearance of Cracks | |
|---|---|---|---|---|---|---|---|---|
| | Flow Density [L/min/m$^2$] | Cooling Time [min] | Recuperation Time [min] | Flow Density [L/min/m$^2$] | Cooling Time [min] | Recuperation Time [min] | Corner Part | Center Part |
| Ex. 1 | 290 | 0.95 | 2 | 170 | 0.95 | 2 | None | None |
| Ex. 2 | 290 | 1.75 | 2 | 210 | 4 | 2 | None | None |
| Ex. 3 | 170 | 0.95 | 2 | 170 | 0.95 | 2 | None | None |
| Ex. 4 | 290 | 4 | 2 | 290 | 4 | 2 | None | None |
| Ex. 5 | 170 | 4 | 2 | 290 | 2 | 2 | None | None |
| Ex. 6 | 210 | 4 | 2 | 210 | 4 | 2 | None | None |

TABLE 2

| | First Water Cooling Step | | First Recuperation Step | Second Water Cooing Step | | Second Recuperation Step | Appearance of Cracks | |
|---|---|---|---|---|---|---|---|---|
| | Flow Density [L/min/m$^2$] | Cooling Time [min] | Recuperation Time [min] | Flow Density [L/min/m$^2$] | Cooling Time [min] | Recuperation Time [min] | Corner Part | Center Part |
| Comp. Ex. 1 | 590 | 1 | 2 | — | — | — | Appear | None |
| Comp. Ex. 2 | 590 | 1.5 | 2 | — | — | — | Appear | None |
| Comp. Ex. 3 | 380 | 1.6 | 2 | — | — | — | Appear | None |
| Comp. Ex. 4 | 450 | 3.2 | 2 | — | — | — | Appear | None |
| Comp. Ex. 5 | 400 | 2.5 | 2 | — | — | — | Appear | None |
| Comp. Ex. 6 | 400 | 5.6 | 2 | — | — | — | None | Appear |
| Comp. Ex. 7 | 170 | 0.95 | 2 | 150 | 4 | 2 | None | Appear |
| Comp. Ex. 8 | 170 | 0.95 | 2 | 300 | 4 | 2 | None | Appear |
| Comp. Ex. 9 | 170 | 0.95 | 2 | 170 | 0.55 | 2 | None | Appear |
| Comp. Ex. 10 | 170 | 0.95 | 2 | 290 | 5 | 2 | None | Appear |

TABLE 2-continued

| | First Water Cooling Step | | First Recuperation Step | Second Water Cooing Step | | Second Recuperation Step | Appearance of Cracks | |
|---|---|---|---|---|---|---|---|---|
| | Flow Density [L/min/m$^2$] | Cooling Time [min] | Recuperation Time [min] | Flow Density [L/min/m$^2$] | Cooling Time [min] | Recuperation Time [min] | Corner Part | Center Part |
| Comp. Ex. 11 | 150 | 4 | 2 | 290 | 4 | 2 | Appear | None |
| Comp. Ex. 12 | 300 | 0.95 | 2 | 170 | 0.95 | 2 | Appear | None |
| Comp. Ex. 13 | 170 | 0.55 | 2 | 290 | 4 | 2 | Appear | None |
| Comp. Ex. 14 | 290 | 5 | 2 | 170 | 0.95 | 2 | Appear | None |
| Comp. Ex. 15 | 400 | 2 | 2 | — | — | — | Appear | None |
| Comp. Ex. 16 | 200 | 2 | 2 | — | — | — | None | Appear |
| Comp. Ex. 17 | 2200 | 0.83 | 2 | 460 | 0.95 | 0.38 | Appear | None |
| Comp. Ex. 18 | 4760 | 1.33 | 2 | 1010 | 1.33 | 2 | Appear | None |
| Comp. Ex. 19 | 2830 | 2 | 2 | 440 | 4 | 2 | Appear | None |
| Comp. Ex. 20 | 4320 | 2 | 2 | 640 | 4 | 2 | Appear | None |

It was confirmed that in every example, the cooling speed of the surfaces of the slab was 1.0 to 3.0° C/sec by heat transfer analysis and measurement of the surface temperature of the slab.

Figure 3:
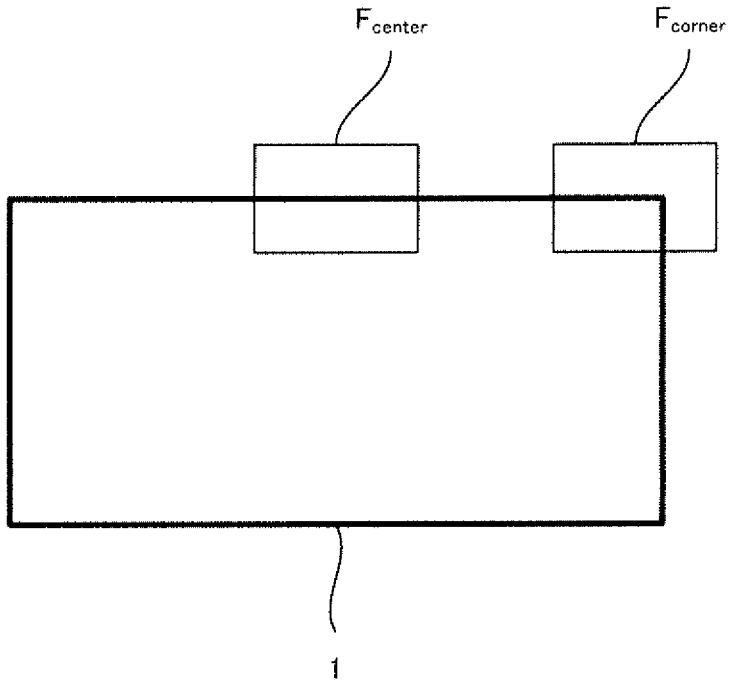
FIG. 3 depicts a region including positions where their structures were observed on a cross-section of the slab.

The obtained slab was cut along a plane for which the longitudinal direction was the direction of the normal line, and the structure of the cross-section was observed with an optical microscope. FIG. 3 depicts a region including the positions where the structures were observed on the cross-section. A corner part $F_{corner}$, and $F_{center}$, which was the center part of a slab 1 in the width direction, and was a region adjacent to a wide surface of the slab 1 (hereinafter simply referred to as "center part"), were observed.

Figure 4:
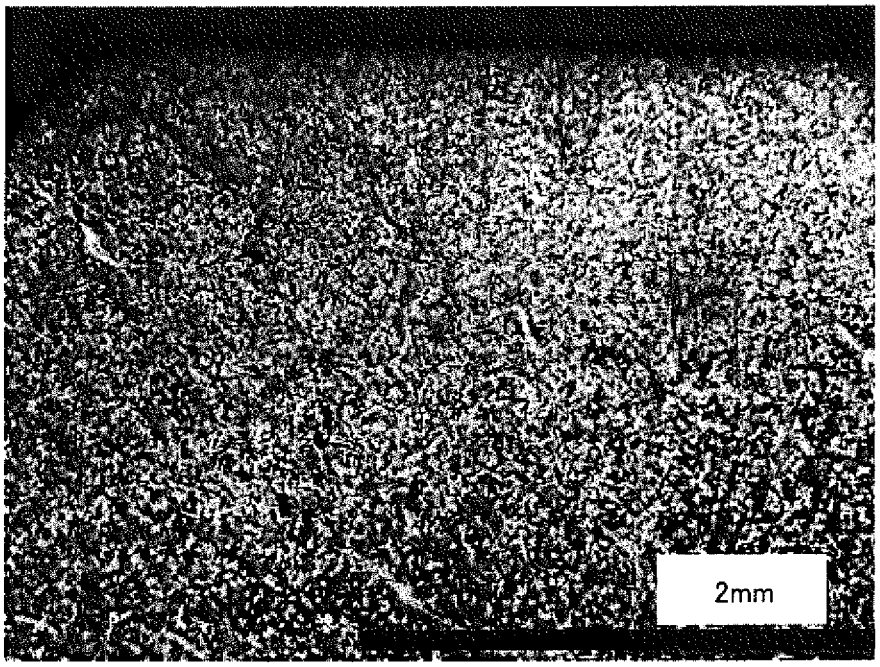
FIG. 4 is an explanatory view of a cross-section of a corner part of the slab on which the continuous casting method of the comparative example 1 was performed.
Figure 5:
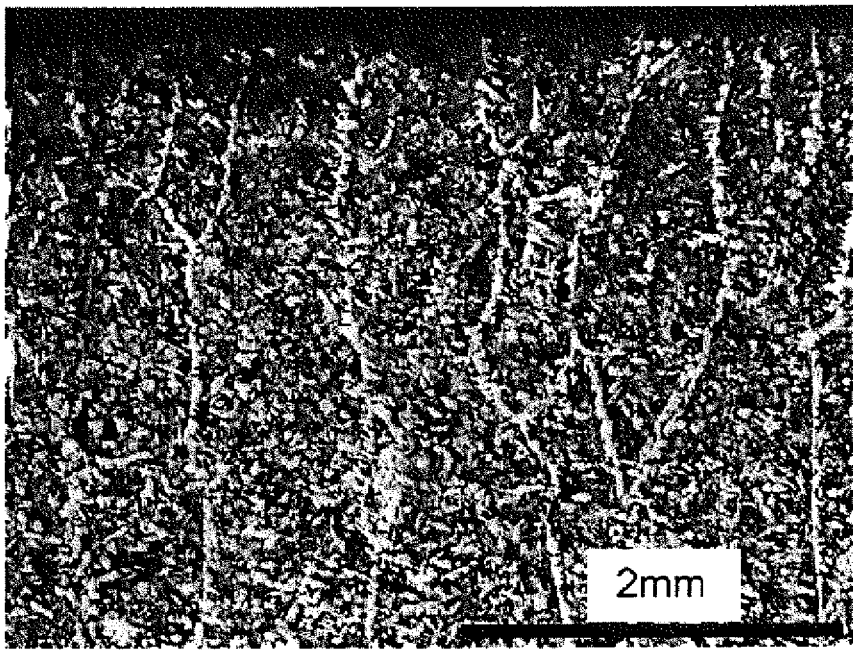
FIG. 5 is an explanatory view of a cross-section of the center part of the slab on which the continuous casting method of the comparative example 6 was performed.
Figure 6:
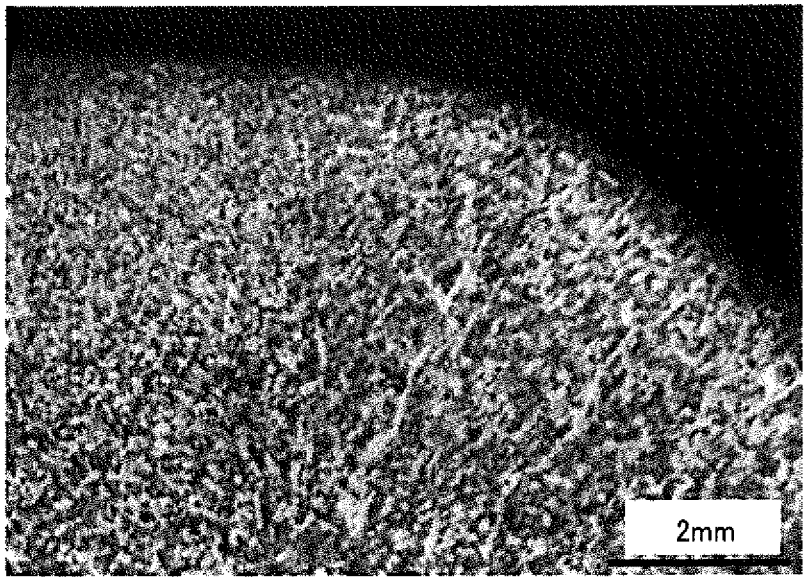
FIG. 6 is an explanatory view of a cross-section of a corner part of the slab on which the continuous casting method of the comparative example 6 was performed.
Figure 7:
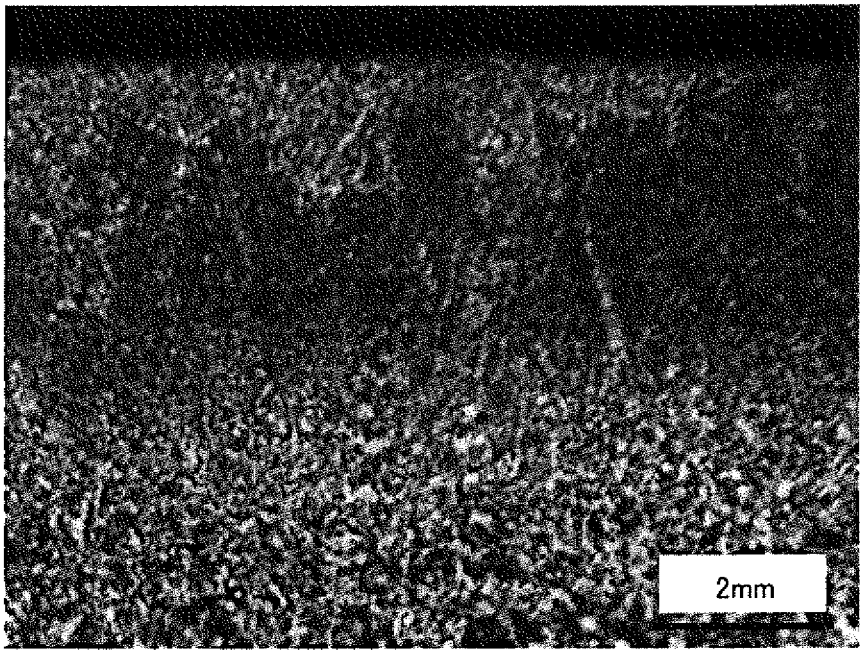
FIG. 7 is an explanatory view of a cross-section of a corner part of the slab on which the continuous casting method of the example 1 was performed.

FIGS. 4 to 7 show photographs of cross-sections of the slab. FIG. 4 is a photograph of a corner part of the slab on which the continuous casting method of the comparative example 1 was performed. FIG. 5 is a photograph of the center part of the cross-section of the slab after the first water cooling step and the first recuperation step were carried out when the continuous casting method of the comparative example 6 was performed. FIG. 6 is a photograph of the corner part of the cross-section of the slab after the first water cooling step and the first recuperation step were carried out when the continuous casting method of the comparative example 6 was performed. FIG. 7 is a photograph of the center part of the cross-section of the slab after the second recuperation step was performed when the continuous casting method of the example 1 was performed.

As shown in FIG. 4, a structure where γ grain boundaries were clear was formed in the corner part of the slab of the comparative example 1. It is considered that this was because in the comparative example 1 where the flow density upon cooling was high, the supercooled corner part was not able to reach temperature of the $Ar_3$ point or above in the following recuperation step, so that the structure was not able to be reformed to that where γ grain boundaries were unclear. In contrast, as shown in FIG. 5, the structure where γ grain boundaries were clear was formed in the center part of the slab of the comparative example 6. It is considered that this was because in the comparative example 6 where the flow density upon cooling was low, the center part was not enough cooled, and the temperature of the outer layer of the center part of the slab did not drop below the $Ar_3$ point.

On the other hand, the structure where γ grain boundaries were unclear was formed in the corner part of the slab of the comparative example 6. It is considered that this was because the temperature of the corner part dropped below the $Ar_3$ point since the corner part was more strongly cooled compared to another portion, and its structure was reformed upon the following recuperation, so that the structure where γ grain boundaries were unclear was formed. The reason why the corner part was more strongly cooled compared to the other portion is considered that, for example, almost all the cooling water supplied to the long sides surfaces of the slab moved along rolls to the corner part, to cool the corner part, and in addition, the corner part was also cooled by cooling water sprayed to the short sides surfaces of the slab. On the other hand, as shown in FIG. 7, the structure where γ grain boundaries were unclear was formed in the center part of the slab of the example 1 after the second recuperation step. Depiction is omitted but the same structure was formed in the corner part of the slab of the example 1 after the second recuperation step.

While cracks appeared in the corner part when the slab of the comparative example 1 was cooled in the first water cooling step, no cracks appeared in all over the surfaces of the slab of the example 1 from the start of the first water cooling step to the end of the second recuperation step.

In addition, as shown in Table 1, no cracks appeared in the corner part and the center part (that is, all over the surfaces. Hereinafter the same will be applied) in every example including the example 1. It is considered that this was because the structure where γ grain boundaries were unclear was able to be formed in the outer layer of the corner part and the center part of the slab by individually reforming the structure of the corner part of the slab and the structure of the portion other than the corner part of the slab, and formation of these structures made it possible to prevent appearance of cracks.

In contrast, as shown in Table 2, cracks appeared in the corner part and the center part of the slab in every comparative example, to which the present invention was not applied. Specifically, cracks appeared in the corner part and the center part in the comparative examples 1 to 6 and 15 to 16, where only one cooling step, which was not divided into two cooling steps, was carried out.

More specifically, cooling was performed in each comparative example 1 to 5 and 15 under cooling conditions of allowing cracks in the center part to be prevented (condition that the flow density was higher than that of examples). If cooling was performed under the cooling conditions of allowing cracks in the center part to be prevented as conventional arts, the corner part was supercooled and thus, the surface temperature of the corner part was not the $Ar_3$ point or above even the recuperation step was carried out. Therefore, in each comparative example 1 to 5 and 15, the structure where γ grain boundaries were unclear was not able to be formed in the outer layer of the corner part, and as a result, cracks appeared in the corner part.

In each comparative example 6 and 16, cooling such that only the surface temperature of the corner part was below the $Ar_3$ point in the first water cooling step was able to be performed; and in the following first recuperation step, the slab was able to be recuperated so that the surface temperature of all the slab including the corner part was the $Ar_3$ point or above. As a result, in each of these comparative examples, the structure where γ grain boundaries were unclear was able to be formed in the outer layer of the corner part and thus, no cracks appeared in the corner part. However, in each comparative example 6 and 16, no second water cooling step or second recuperation step was performed. Thus, the structure where γ grain boundaries were unclear was not able to be formed in the center part. As a result, cracks appeared in the center part.

In each comparative example 7 to 10, the slab was able to be cooled so that only the surface temperature of the corner part was below the $Ar_3$ point in the first water cooling step, and in the following first recuperation step, the slab was able to be recuperated so that the surface temperature of all the slab including the corner part was the $Ar_3$ point or above. As a result, in each comparative example 7 to 10, the structure where γ grain boundaries were unclear was able to be formed in the outer layer of the corner part and thus, no cracks appeared in the corner part.

However, in the comparative example 7, the slab was not able to be cooled so that the surface temperature of the center part was not below the $Ar_3$ point in the second water cooling step. As a result, in the comparative example 7, the structure where γ grain boundaries were unclear was not able to be formed in the center part. Thus, cracks appeared in the center part.

In the comparative example 8, the slab was not able to be recuperated so that the surface temperature of the center part was not the $Ar_3$ point or above in the second recuperation step because the center part was too cooled in the second water cooling step. As a result, in the comparative example 8, the structure where γ grain boundaries were unclear was not able to be formed in the center part. Thus, cracks appeared in the center part.

In the comparative example 9, the slab was not able to be cooled so that the surface temperature of the center part was not below the $Ar_3$ point in the second water cooling step. As a result, in the comparative example 9, the structure where γ grain boundaries were unclear was not able to be formed in the center part. Thus, cracks appeared in the center part.

In the comparative example 10, the slab was not able to be recuperated so that the surface temperature of the center part was not the $Ar_3$ point or above in the second recuperation step because the center part was too cooled in the second water cooling step. As a result, in the comparative example 10, the structure where γ grain boundaries were unclear was not able to be formed in the center part. Thus, cracks appeared in the center part.

In each comparative example 11 to 14, the slab was able to be cooled so that the surface temperature of all the slab including the corner part was below the $Ar_3$ point in the second water cooling step, and in the following second recuperation step, the slab was able to be recuperated so that the surface temperature of the corner part was kept below the $Ar_3$ point, and the surface temperature of the center part was the $Ar_3$ point or above. As a result, in each comparative example 11 to 14, the structure where γ grain boundaries were unclear was able to be formed in the outer layer of the center part and thus, no cracks appeared in the center part.

However, in the comparative example 11, the slab was not able to be cooled so that the surface temperature of the corner part was not below the $Ar_3$ point in the first water cooling step. As a result, in the comparative example 11, the structure where y grain boundaries were unclear was not able to be formed in the corner part. Thus, cracks appeared in the corner part.

In the comparative example 12, the slab was not able to be recuperated so that the surface temperature of the corner part was not the $Ar_3$ point or above in the first recuperation step because the corner part was too cooled in the first water cooling step. As a result, in the comparative example 12, the structure where γ grain boundaries were unclear was not able to be formed in the corner part. Thus, cracks appeared in the corner part.

In the comparative example 13, the slab was not able to be cooled so that the surface temperature of the corner part was not below the $Ar_3$ point in the first water cooling step. As a result, in the comparative example 13, the structure where γ grain boundaries were unclear was not able to be formed in the corner part. Thus, cracks appeared in the corner part.

In the comparative example 14, the slab was not able to be recuperated so that the surface temperature of the corner part was not the $Ar_3$ point or above in the first recuperation step because the center part was too cooled in the first water cooling step. As a result, in the comparative example 14, the structure where γ grain boundaries were unclear was not able to be formed in the corner part. Thus, cracks appeared in the corner part.

In each comparative example 17 to 20, the slab was able to be cooled so that the surface temperature of all the slab including the corner part was below the $Ar_3$ point in the first water cooling step. However, in each comparative example 17 to 20, the slab was not able to be recuperated so that the surface temperature of the corner part was not the $Ar_3$ point or above in the first recuperation step because the corner part was too cooled in the first water cooling step. As a result, in each comparative example 17 to 20, the structure where γ grain boundaries were unclear was not able to be formed in the corner part. Thus, cracks appeared in the corner part.

REFERENCE SIGNS LIST

1 . . . slab

The invention claimed is:

1. A method for continuously casting a slab using a curved type or vertical bending type continuous casting machine, the method comprising:

the step of cooling the slab just beneath a mold in a secondary cooling zone, the slab being withdrawn from the mold, the step further comprising: a first water cooling step, a first recuperation step that follows the first water cooling step, a second water cooling step that follows the first recuperation step, and a second recuperation step that follows the second water cooling step, wherein the first water cooling step is a step of cooling the slab of which a surface temperature is no less than 1000° C., by supplying cooling water to wide surfaces of the slab, including that only a surface temperature of a corner part is below $Ar_3$ point, and a surface temperature of a portion of the slab other than the corner part is kept no less than $Ar_3$ point, the corner part being a region within 20 mm from an apex and edges of the slab, the first recuperation step is a step of recuperating the slab including that the surface temperature of all the slab including the corner part is no less than the $Ar_3$ point, the second water cooing step is a step of cooling the slab of which the surface temperature is the $Ar_3$ point to 900° C., by supplying the cooling water to the wide surfaces of the slab, including that the surface temperature of all the slab including the corner part is below the $Ar_3$ point, and the second recuperation step is a step of recuperating the slab including that the surface temperature of the corner part is kept below the $Ar_3$ point, and the surface temperature of the portion of the slab other than the corner part is no less than the $Ar_3$ point.

2. The method for continuously casting a slab according to claim 1, wherein flow density of the cooling water supplied to the slab in the first water cooling step is 170 to 290 L/min/$m^2$, and time for supplying the cooling water to the slab in the first water cooling step is 0.95 to 4.0 minutes.

3. The method for continuously casting a slab according to claim 2, the method comprising at least one step selected from the group consisting of:

the first recuperation step wherein time for recuperating the slab is no less than 2 minutes, and the second recuperation step wherein time for recuperating the slab is no less than 2 minutes.

4. The method for continuously casting a slab according to claim 2, wherein flow density of the cooling water supplied to the slab in the second water cooling step is 170 to 290 L/min/$m^2$, and time for supplying the cooling water to the slab in the second water cooling step is 0.95 to 4.0 minutes.

5. The method for continuously casting a slab according to claim 4, the method comprising at least one step selected from the group consisting of:

the first recuperation step wherein time for recuperating the slab is no less than 2 minutes, and the second recuperation step wherein time for recuperating the slab is no less than 2 minutes.

6. The method for continuously casting a slab according to claim 1, wherein flow density of the cooling water supplied to the slab in the second water cooling step is 170 to 290 L/min/$m^2$, and time for supplying the cooling water to the slab in the second water cooling step is 0.95 to 4.0 minutes.

7. The method for continuously casting a slab according to claim 6, the method comprising at least one step selected from the group consisting of:

the first recuperation step wherein time for recuperating the slab is no less than 2 minutes, and the second recuperation step wherein time for recuperating the slab is no less than 2 minutes.

8. The method for continuously casting a slab according to claim 1, the method comprising at least one step selected from the group consisting of:

the first recuperation step wherein time for recuperating the slab is no less than 2 minutes, and the second recuperation step wherein time for recuperating the slab is no less than 2 minutes.

* * * * *